United States Patent [19]

Yeu

[11] Patent Number: 4,676,764

[45] Date of Patent: Jun. 30, 1987

[54] DANCING DOLL WITH HIP MOVEMENT AND 180° ROTATION

[75] Inventor: Nam-Jin Yeu, Seoul, Rep. of Korea

[73] Assignee: Michael & Park's Trading and Sales, Inc., Honolulu, Hi.

[21] Appl. No.: 812,285

[22] Filed: Dec. 23, 1985

[51] Int. Cl.[4] ..... A63H 13/04

[52] U.S. Cl. ..... 446/298; 446/352; 446/358

[58] Field of Search ..... 446/298, 299, 300, 190, 446/330, 352, 353, 357, 358

[56] References Cited

U.S. PATENT DOCUMENTS

| | | | |
|---|---|---|---|
| 1,207,022 | 12/1916 | Green | 446/190 X |
| 1,410,429 | 3/1922 | Vaughan | D21/166 X |
| 2,526,886 | 10/1950 | MacDonald | 446/358 |
| 3,380,656 | 4/1968 | Ito | 446/124 X |
| 3,456,950 | 7/1969 | Goldfarb | 446/330 |
| 3,672,097 | 6/1972 | Gardel et al. | 446/352 |
| 3,710,507 | 1/1973 | Poynter | 446/74 |
| 3,888,023 | 6/1975 | Genin | 446/358 X |
| 4,052,813 | 10/1977 | Crain et al. | 446/352 |
| 4,545,775 | 10/1985 | Kim | 446/299 |
| 4,573,939 | 3/1986 | Hoshino | 446/298 |

FOREIGN PATENT DOCUMENTS

| | | | |
|---|---|---|---|
| 3400814 | 7/1985 | Fed. Rep. of Germany | 446/352 |
| 370473 | 4/1932 | United Kingdom | 446/352 |

*Primary Examiner*—Robert A. Hafer

*Assistant Examiner*—Terrence L. B. Brown

*Attorney, Agent, or Firm*—George W. T. Loo

[57] ABSTRACT

A dancing doll which alternately moves its hips left and right while alternately rotating 180° clockwise and counterclockwise to a melody. The doll includes an upper portion, a hip portion, a leg portion, and a base portion. The upper portion resembles the head to hip portion of a human; the hip portion resembles the hips of a human; and the leg portion resembles the legs through feet of a human. The base portion includes a covering case with a rotating disc at its bottom, a base plate that is pivotally connected to the rotating disc, a switch, a battery, a motor, an I.C. Unit, a speaker, a prime gear, a cam, an actuator, and gearing which will transmit the motion of the motor to the cam and to the actuator and will cause the alternate turning of the rotating disc. A pin pivotally connects the upper portion to the hip portion and a torso supporter, which extends from the right leg into a cavity in the upper portion. The feet are connected to the top of the covering case. An actuating rod passes through the covering case and left leg and is connected at one end to the actuator and at the other end to the hip portion. When the switch is turned on, the motor moves the actuator up and down which alternately moves the hips of the doll left and right and turns the cam that in turn alternately moves the doll in a clockwise or counterclockwise direction while a melody is heard.

4 Claims, 5 Drawing Figures

DANCING DOLL WITH HIP MOVEMENT AND 180° ROTATION

BACKGROUND OF INVENTION

1. Field of Invention

The doll differs from the conventionally fixed and monotonous one showing nothing but its appearance in that the former dances to given melodies swinging hips with vibration and the aid of electro-mechanical devices. Further, as it dances, with it partly exposed legs and feet atop the cover encasing the electro-mechanical assembly, the whole system in connection except for a base plate rotates synchronously 180° clockwise and counterclockwise alternately, thus, enabling the amused audience to watch the animated frontal, side and rear views of the doll bi-directionally and in repetition. The tri-faceted views can be had in one half of the time required in the case of mono-directional 360° rotation mentioned herebelow as a matter of prior art.

2. Prior Art

The inventor herein has for years been engaged in research and development of various toys and dolls as a matter of professional specialty. Toward the end of 1983, he embarked on revolutionizing fixed dolls into animated ones with or without accompanying melodies. Then, in 1984, he came up with a doll dancing to given Hawaiian melodies. It was revolutionary in that the doll was not stationary and motionless but was made to swing its hips and rotate along with its mechanical assembly. The first product, however, was so structured that the legs and feet were not shown. Instead the space for them was filled with a cylinder covered with simulated Hawaiian skirt and containing an electro-mechanical system. So, subsequently, he improved the doll in such a way that it the doll's entire body with its legs and feet exposed was placed atop a rotating circular case containing the electro-mechanical assembly. (Thereafter, as of June 17, 1985, he filed application for patents with the South Korean patent authorities on both of the initial and improved versions separately under the common categorical title of "Animated Toy" or "JAK-TONG WANGOO" in Korean with the application Nos. 7219 and 7218 assigned respectively.)

SUMMARY OF INVENTION

The invention relates to a device making a doll not only dance to given melodies but also rotate 180° clockwise and counterclockwise alternately for dynamic and melodious enjoyment. The 180° rotation in lieu of 360° rotation is designed to eliminate the monotony accompanying the latter movement and add variety to the rotation.

The electro-mechanical assembly is so located and encased and, thus, production and maintenance was made easy.

It shows the perspective view of the toy as well as the cross sectional view of the electro-mechanical assembly with its electro-audio chamber to the right and mechanical chamber to the left.

FIG. 2:

It gives an exploded view of the doll's body and a device attached to the mechanical assembly depicting the hook-ups involved.

FIG. 3:

It is an enlarged detailed sectional view of the mechanical assembly and its attached device.

FIG. 4:

It is perspective view of the mechanical assembly and its attached device involved in the counterclockwise rotation.

FIG. 5:

it is a perspective view of the mechanical assembly and its attached device involved in the clockwise rotation.

DESCRIPTION OF PREFERRED EMBODIMENT

Covering Case (1) encases the entire electro-mechanical assembly including the audio system, all of which are mounted on Rotation Disc (9) supported by Base Plate (6) with its Basing Feet (7).

Between Rotating Disc (9) and Base Plate (6) is Rotation Pivot (8) enabling the intended rotation with Switch (5) on. Thus, the entire body of the doll fixed atop Covering Case (1) with its feet riveted by Fixing Pin (44d & 45d) to the covering case which, in turn, is connected to the rotating disc is bound to rotate simultaneously. There is no relative movement between the riveted feet and Covering Case (1). There is no movement of the legs in response to movements of Hips (22).

The power necessary for the entire functioning is generated by the batteries contained in Battery Chamber (2) which is connected to IC Unit (3) and Speaker (4) as well for generation of melodies.

The vertical Support Panels (10 and **10*a*) supports the entire mechanical assembly including the horizontal shafts, the gears thereon and the attached Actuator (21) and Cam (30) which perform as follows respectively with Motor (11**) in operation:

(a) Motor (11) drives Prime Gear (12) clockwise turning Gears (13 and 15) on Main Shaft (14) counterclockwise.

(b) Gear (15) drives Gears (17, **17*a* and 18) on Cam Actuated Shaft (16) directly or indirectly and drives Gear (19) on Cranking Shaft (20**) directly.

(c) With Cranking Shaft (20) rolling Bell Crank (**20*a*) at the extended end connected to Actuator (21) through Actuator Hole (21*b*) keeps cranking to move Actuator (21) up and down through its indented Bracket (46**), which up-and-down movement is designed to help the hips of the doll swing as explained later.

Figure 4:
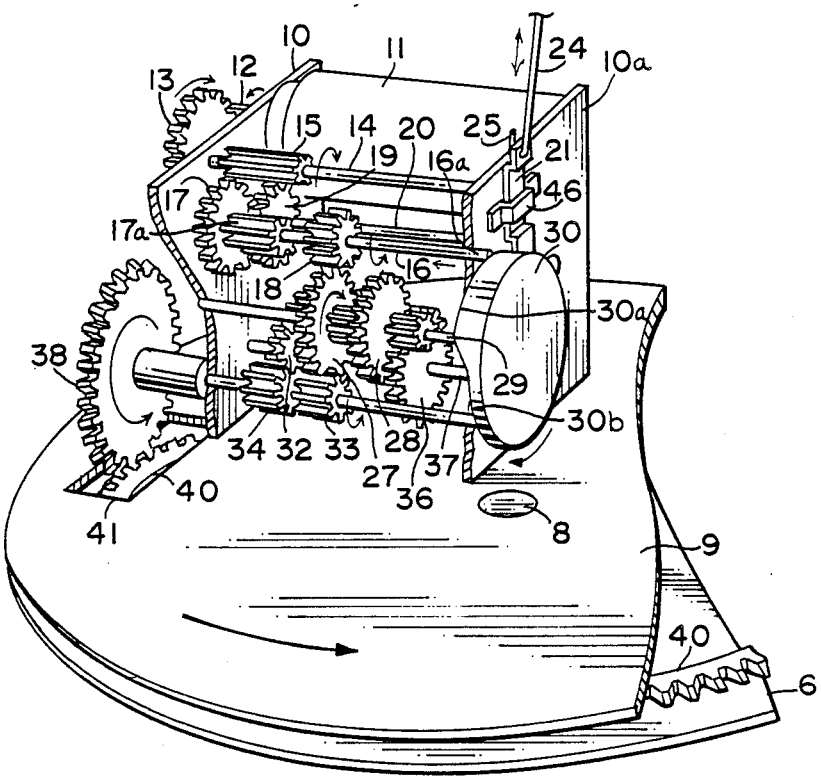
Figure 5:
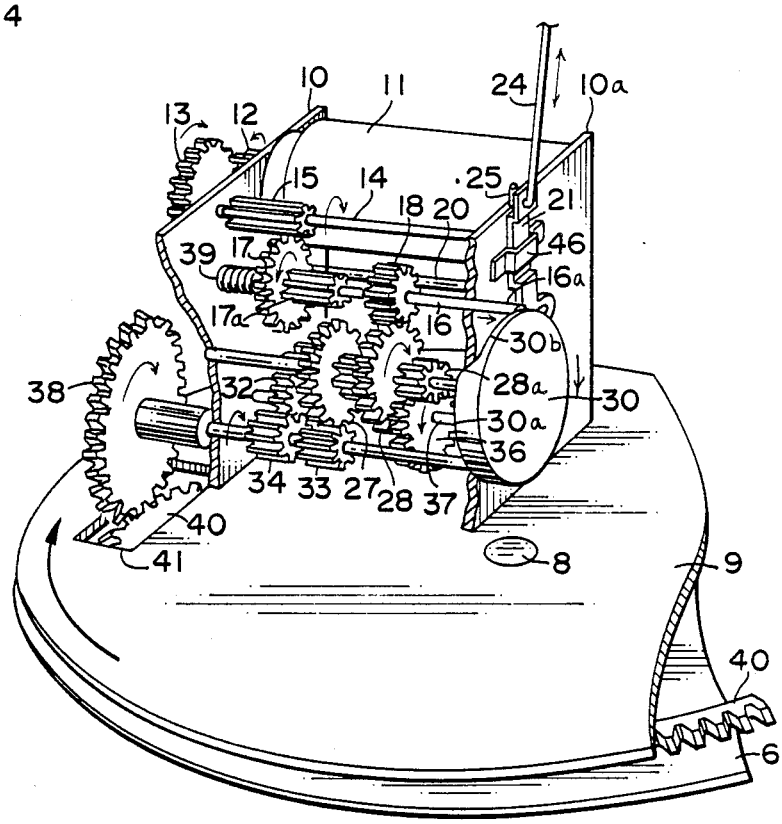

(d) Alternate Gears (27 and 28) and Gear (**28*a*) are connected to Cam (30) on Shaft (29). Cam (30) has its wide Rim (30*a*) and narrow Rim (30*b*) evenly distributed with smooth graduation at the transitory points. Cam Actuated Shaft (16) either presses Spring (39) or releases it depending on its contact with the wide or narrow Rim (30*a* or 30*b*) in alternation. See FIGS. 4 and 5. With the spring pressed, Gear (18) on Cam Shaft (16) is connected to alternate Gear (27) on Shaft (29) for enabling counterclockwise rotation. See FIG. 4. With spring released, the same Gear (18) is connected to the other alternate Gear (28) on the same Shaft (29) for enabling the intended counterclockwise or clockwise rotation. See FIG. 5. Alternate Gear (27) on Shaft (29) is connected to Gear (33) on Shaft (35) while Gear (28*a*) on Shaft (29) is connected to Gear (36) on Shaft (37). Shaft (37) has the other Gear (32) which is connected to Gear (34) on Shaft (35) thus completing the inter-shaft connections through gears and providing clockwise rotation. At the left end of Shaft (35) is Bevel Gear (38) connected to Bevel Rotation Gear (40**) through Slot

(41) on Rotating Disk (9) Which is to rotate 180° clockwise or counterclockwise alternately above Base Plate (6) with the aid of Rotation Pivot (8) in-between, depending on whether Alternation Gear (27) or (28) is put in operation.

Figure 1:
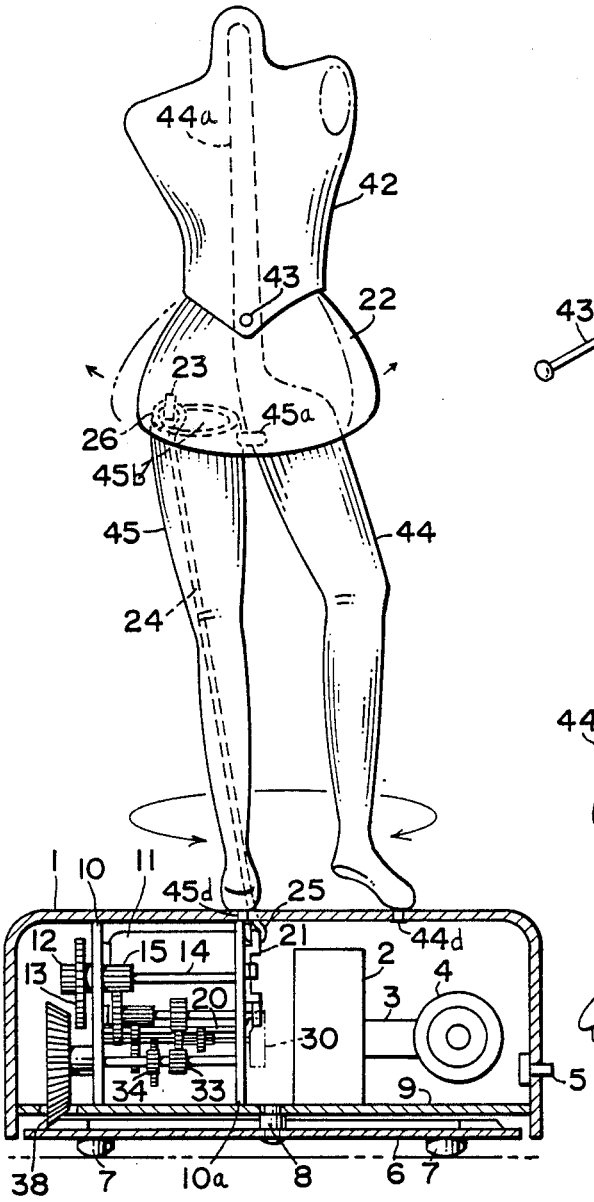
FIG. 1.
Figure 2:
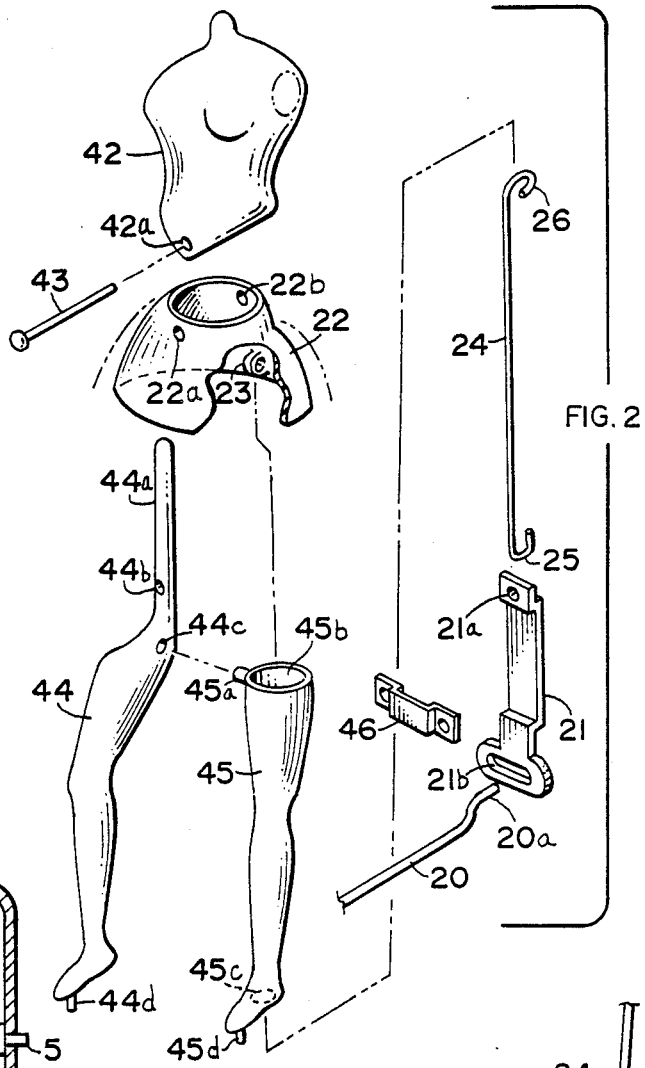
Figure 3:
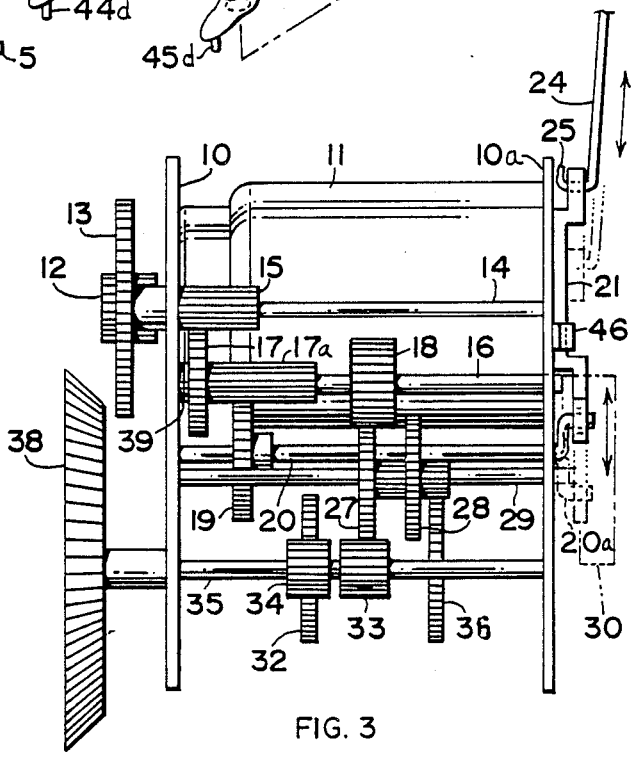

Concurrently with the afore mentioned simultaneous rotation of the entire structure except Base Plate (6), The hips of the doll swings as follows with vibrating effect of the rotation and other mechanism involved:

(a) In FIG. 2 the upper end of Actuator (21) has Actuator hole (21*a*) through which Actuating Rod (24) is connected with Lower Hook (25) with sufficient room for maneuverability of the hook in response to the up-and-down movement of Actuator (21) explained earlier.

(b) Upper Hook (26) of Actuating Rod (24) goes through Foot Sole Opening (45*c*) and the hollow Leg Space (45*b*) of Left Leg (45) for connection with Hip Connecting Hole (23) for receiving the upper hook (26) with sufficient room for maneuverablity of Actuating Rod (24) in response to the up-and-down movement of Actuator (24) at the upper end as well.

(c) Meanwhile, Leg-connection Pin (45*a*) on the Left leg (45) joins the left leg with Right Leg (44) through Connection Opening (44*c*) with sufficient room for maneuverability of Leg-connection Pin (45*a*) in response to the movement of Actuating Rod (24), which movement is derived from that of Actuator (24).

(d) Extended from Right Leg (44) is Torso Supporter (44*a*) with its Torso Connecting Hinge Pin Hole (44*b*) for connection with Hips (22) with its Connection Holes (22*a* and 22*b*) and, further with Torso (42) through its Connection Hole (42*a*). Connection of the three parts, namely, the Right Leg (44), Hips (22) and Torso (42) is effected by inserting Connection Pin (43) through the holes 42*a*, 22*a*, 44*b* and 22*b* in that order with sufficient room for maneuverability in response to the up-and-down movement of Actuator (21) directly or indirectly.

Thus, in sum, the rotational system gives some vibrating effect to the doll while, prompted by the up-and-down movement of actuator (21) deriving from the motion of Cranking Shaft (20), the hips of the doll swings multidirectionally to given melodies with the room for maneuverability of the vaious joints mentioned above.

I claim:

1. A dancing doll comprising an upper portion, a hip portion, a leg portion, and a base portion;

said upper portion and said hip portion each defining respective cavities;

said leg portion comprising two legs, one of said legs further comprises an integrally connected torso supporter, said torso supporter comprising an elongated extension of said one of said legs; said torso supporter extending into said cavity of said upper portion;

said torso supporter having a pivotal connection for pivotably attaching said upper portion and said hip portion to said torso supporter;

the base portion includes a covering case with a rotating disc attached to its bottom and a base plate that is pivotally connected to the rotating disc;

the legs have feet and said feet are connected to the top of the covering case;

means are connected to the covering case for alternately turning the covering case counterclockwise and clockwise for a predetermined distance;

an actuator is operatively connected to said turning means, and said actuator is connected to means for connecting said actuator and said hip portion for moving the hip portion about said pivotal connection by reciprocating action.

2. The dancing doll of claim 1, with a switch connected to the the actuator and circuit means for playing an electronic melody, a speaker, and said speaker and said circuit means are connected to a means for accepting a battery within the covering case.

3. The dancing doll of claim 2, wherein the means for alternately turning the covering case counterclockwise and clockwise for a predetermined distance includes a motor, a primer gear and two additional spaced gears on a main shaft, a gear on a cranking shaft, a spring and at least two spaced gears on a cam-actuated shaft, two spaced alternate gears and a third gear on a cam shaft with a cam connected to one end of the cam shaft, two spaced gears on a bevel gear shaft with a bevel gear connected to one end of the bevel gear shaft, two spaced gears on a last shaft, a bevel rotation gear, and two spaced support panels; said prime gear is connected to the shaft of the motor and meshes with one of the gears on the main shaft; the other gear on the main shaft meshes with one of the gears on the cam-actuated shaft and with the gear on the cranking shaft; the other gear on the cam-actuated shaft alternately meshes with the two alternate gears depending on the position of the cam; one of the alternate gears meshes with one of the gears on the bevel gear shaft; the third gear on the cam shaft meshes with one of the spaced gears of the last shaft; the other spaced gear on the last shaft meshes with the other one of the gears on the bevel gear shaft; the bevel gear meshes with the bevel rotation gear through a slot in the rotating disk; and all of the shafts are supported by the two spaced support panels.

4. The dancing doll of claim 3, wherein the means for moving the hip portion by reciprocating action of the actuator includes, a bracket and an actuating rod; the actuator is connected at one end to one end of the cranking shaft and at the other end to one end of the actuating rod; the bracket is secured to the side of one of the support panels so that the actuator passes through the bracket; and the actuating rod passes through the left leg and its other end is connected to the hip portion.

* * * * *